United States Patent [19]

Petermann

[11] Patent Number: 4,766,955

[45] Date of Patent: Aug. 30, 1988

[54] WELLBORE FLUID SAMPLING APPARATUS

[75] Inventor: Steven G. Petermann, Plano, Tex.

[73] Assignee: Atlantic Richfield Company, Los Angeles, Calif.

[21] Appl. No.: 36,727

[22] Filed: Apr. 10, 1987

[51] Int. Cl.[4] ..... E21B 49/08

[52] U.S. Cl. ..... 166/167; 166/169; 166/264

[58] Field of Search ..... 166/57, 61, 165, 167, 166/168, 169, 264; 175/59, 233

[56] References Cited

U.S. PATENT DOCUMENTS

| | | | |
|---|---|---|---|
| 2,911,047 | 11/1959 | Henderson | 166/61 |
| 3,254,531 | 6/1966 | Briggs, Jr. | 166/264 X |
| 3,294,170 | 12/1966 | Warren et al. | 166/264 X |
| 4,417,622 | 11/1983 | Hude | 166/264 |
| 4,502,537 | 3/1985 | Carter, Sr. | 166/264 X |
| 4,597,439 | 7/1986 | Meek | 166/264 X |

*Primary Examiner*—Stephen J. Novosad
*Assistant Examiner*—William P. Neuder
*Attorney, Agent, or Firm*—Michael E. Martin

[57] ABSTRACT

A wellbore fluid sampling apparatus includes an elongated tubular housing having a floating piston disposed therein and dividing a bore in the housing into first and second chambers, one of the chambers being in communication with ports in the sidewall of the housing for receiving a sample of wellbore fluid in response to movement of the piston to enlarge the one chamber. The other chamber is charged with a liquid to prevent displacement of the piston until a control valve in the housing allows charging fluid to escape into a reservoir chamber whereby the piston moves to receive the fluid sample under wellbore pressure. The floating piston actuates a rod connected to a closure member to close off the bore in the fluid sampling chamber when a suitable fluid sample is obtained. A detent locks the actuating rod and the closure member in the closed position to capture the fluid sample for retrieval and analysis.

18 Claims, 5 Drawing Sheets

WELLBORE FLUID SAMPLING APPARATUS

BACKGROUND OF THE INVENTION

1. Field of the Invention

The present invention pertains to an apparatus for insertion in a subterranean wellbore or a similar environment for obtaining a sample of fluid present in the wellbore.

2. Backgound of the Invention

In the development of petroleum reservoirs and other situations where a sample of fluid is desired from time to time, certain considerations must be given to the condition of the fluid being sampled, the pressures present in the fluid body being sampled and the remote location of the apparatus when the fluid sample is being obtained. In particular, the sampling of viscous crude oils from subterranean wells present certain problems in filling the sample cavity in a sampling device and suitably capturing the sample, taking into consideration the pressures and temperatures present in the wellbore at the sampling site. In these respects, and also taking into considerations other desiderata which will be appreciated by those skilled in the art, the present invention has been developed with a view to providing an improved wellbore fluid sampling apparatus particularly adapted for sampling viscous crude oils and similar liquids.

SUMMARY OF THE INVENTION

The present invention provides an improved fluid sampling apparatus particularly adapted for sampling wellbore fluids such as relatively viscous crude oils and the like.

In accordance with an important aspect of the present invention, a fluid sampling apparatus is provided which is responsive to wellbore fluid pressures to fill a cavity formed in the sampling apparatus with the wellbore fluid at a selected sampling site, utilizing a floating piston which expands a chamber to be filled with a liquid to be sampled while displacing liquid from a second chamber into a storage cavity in the apparatus. In this way, wellbore pressure acting on the fluid to be sampled operates the apparatus to move the piston which expands the sampled fluid cavity in the apparatus.

In accordance with another important aspect of the present invention, a closure member for the sampled fluid cavity is automatically actuated to capture the sample when the volume of the sample has reached a predetermined amount and the closure member is automatically locked in the closed position to prevent leakage or contamination of the sample upon removal of the apparatus from the sampling site. The sample cavity closure member is also provided with a unique seal protector to minimize damage to the closure member seals during use of the apparatus in capturing fluids which are laden with sand or other abrasives.

In accordance with yet another important aspect of the present invention, there is provided a remotely controlled fluid sampling apparatus for wellbores and the like which is selectively operated to expand a cavity for capturing a fluid sample by displacing a quantity of operating fluid in the sampling apparatus, the flow of which fluid is controlled by a motor operated valve to move from one cavity in the apparatus to another, and whereby the same actuating fluid is utilized to displace the sampled fluid from the apparatus when the sample is to be retrieved for analysis.

Those skilled in the art will recognize additional features and superior aspects of the present invention upon reading the detailed description which follows in conjunction with the drawing.

DESCRIPTION OF A PREFERRED EMBODIMENT

Figure 1:
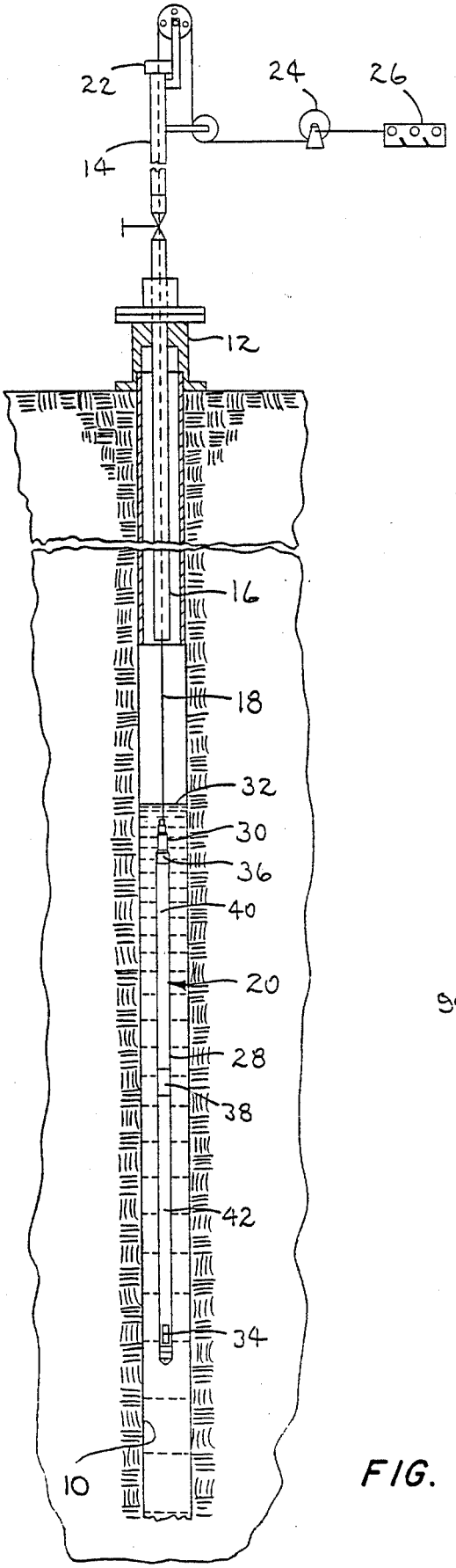
FIG. 1 is a vertical section view of a well for recovering hydrocarbon fluids illustrating the installation of the apparatus in a position for sampling wellbore fluid.

In the description which follows, like parts are marked throughout the specification and drawing with the same reference numerals, respectively. Drawing FIGS. 2A through 2D, 5A through 5B and 6A through 6B are intended to be viewed as if laid end to end, respectively, with certain portions of the structure of the apparatus removed in the interest of clarity and conciseness. The drawing figures are not necessarily to scale and certain features may be shown exaggerated in scale or in somewhat schematic form.

Referring to FIG. 1, there is illustrated a subterranean wellbore 10 which extends to wellhead 12 adapted to have a suitable wireline lubricator or the like 14 mounted thereon. A tubing string 16 extends into the wellbore from the wellhead 12 and through which a conventional wireline type multi-conductor electric cable 18 is shown to extend into the wellbore and connected to a wellbore fluid sampling apparatus 20 in accordance with the present invention. The wireline 18 extends through the lubricator 14, a stuffing box 22 and over a conventional arrangement of sheaves to a cable reel or the like 24. A suitable source of electrical energy and control switches 26 is electrically connected to the wireline 18 using conventional commercially available components. As illustrated in FIG. 1, the fluid sampling apparatus 20 is characterized by an elongated tubular body 28 which is suspended from the wireline 18 by a conventional coupling 30. The apparatus 20 is shown immersed in wellbore fluid 32 and the body 28 includes a plurality of fluid intake ports 34, one shown in FIG. 1, for the intake of a sample of wellbore fluid when the apparatus is operated in accordance with the description which follows herein.

Figure 4:
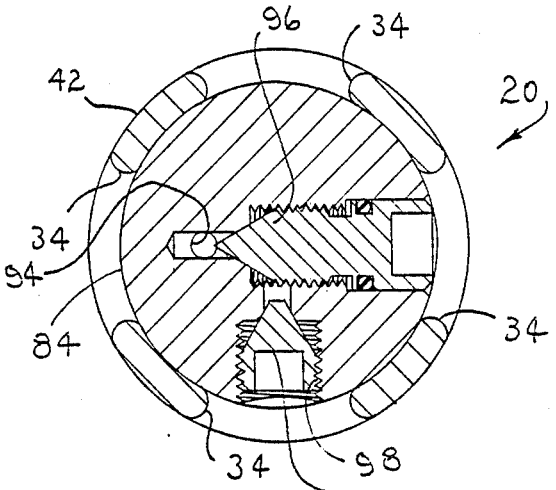
FIG. 4 is a section view taken along the line 4—4 of FIG. 2D.
Figure 2A:
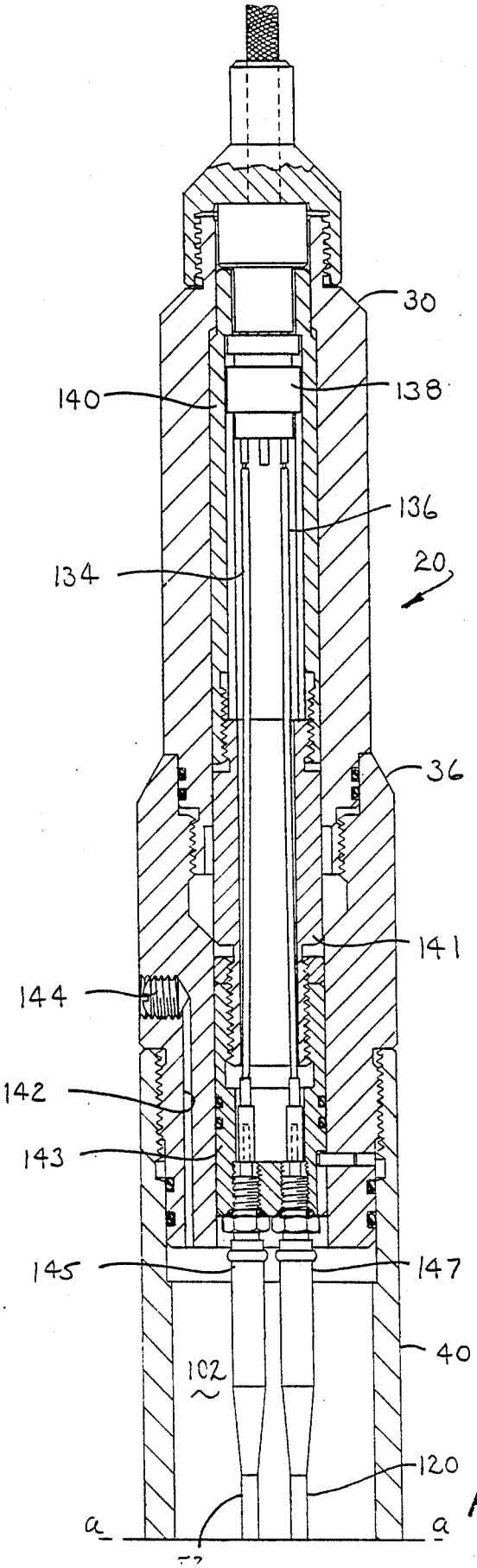
FIGS. 2A through 2D comprise a longitudinal central section view through the fluid sampling apparatus of the present invention.
Figure 2B:
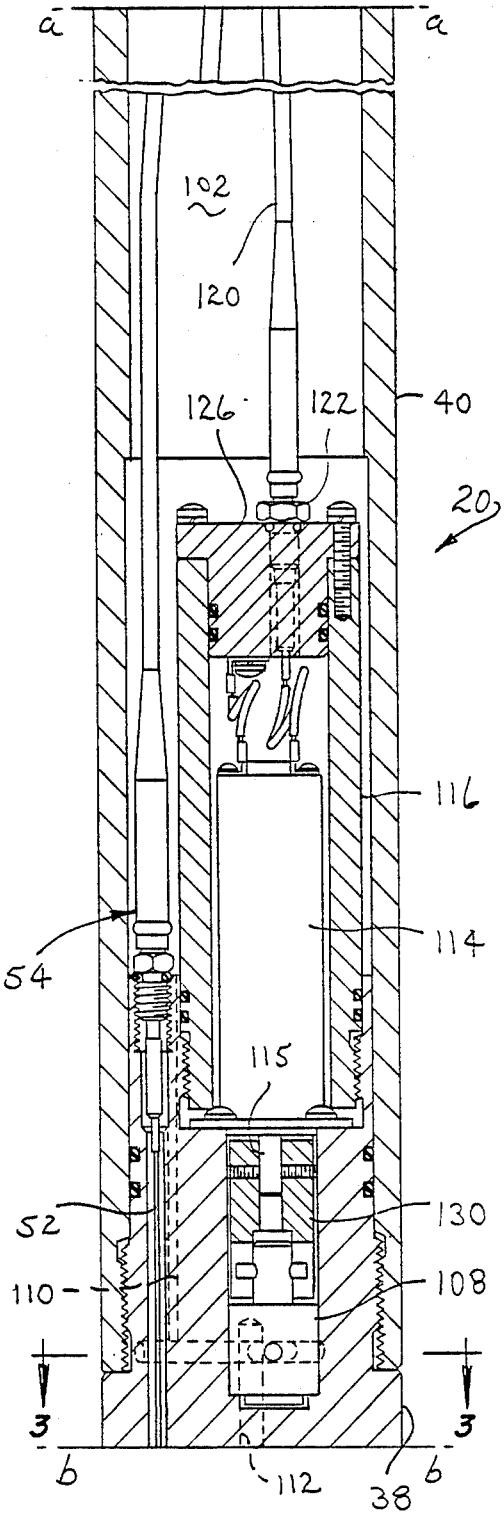
Figure 2C:
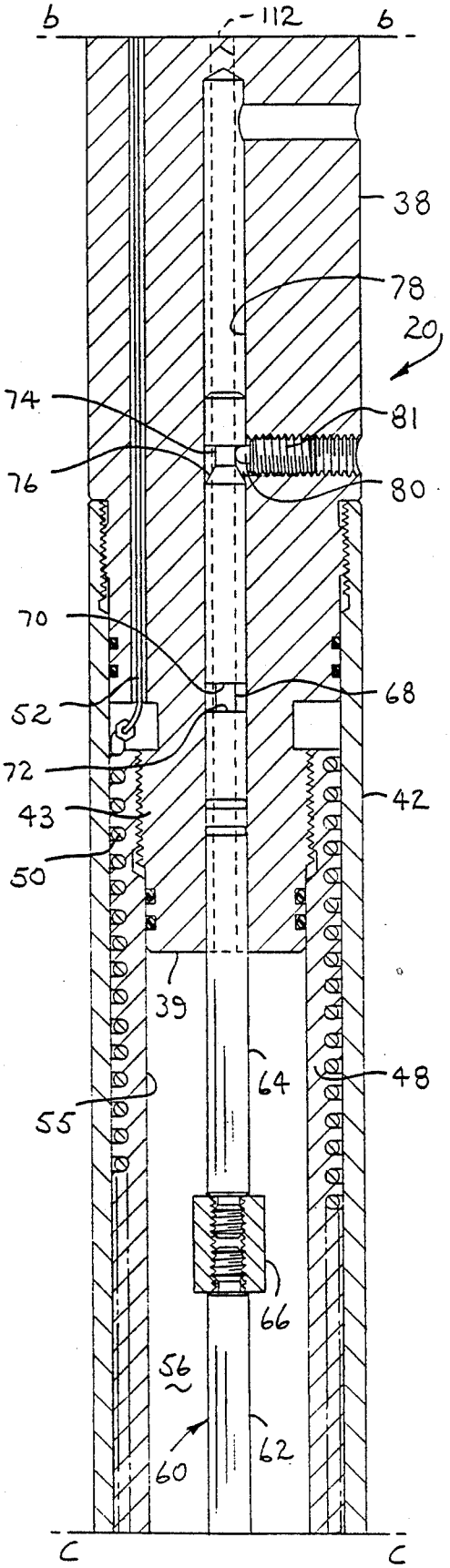
Figure 2D:
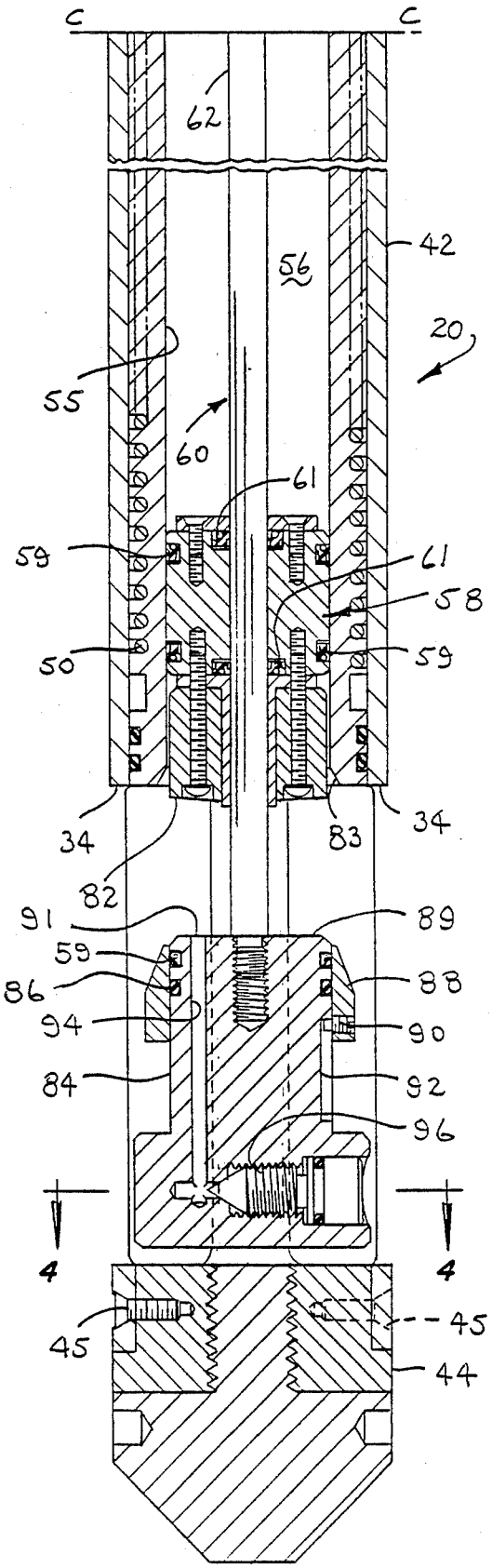

Referring now to FIGS. 2A through 2D, the sampling apparatus 20 is illustrated in longitudinal central section and is characterized by the tubular body 28 which is made up of an upper head member 36, FIG. 2A, and an intermediate head member 38, FIG. 2B, interconnected by a cylindrical tubular body part 40. The body part 40 is suitably internally threaded at its opposite ends for threaded connection to the head members 36 and 38 as illustrated. The head member 38 is also adapted to be threadedly connected to a second tubular body part 42, FIGS. 2C and 2D, which extends between the intermediate head member and a lower head member 44. As illustrated in FIG. 2D and FIG. 4, the body part 42 includes a plurality of fluid inlet ports 34 arranged spaced apart about its circumference adjacent to head member 44. The body part 42 is secured to the head member 44 by a plurality of threaded fasteners 45 as illustrated in FIG. 2D. A removable end cap 47 is threadedly connected to the lower head member 44 as illustrated.

Referring to FIGS. 2C and 2D, the body part 42 is provided with an internal tubular liner 48 which is threadedly connected at one end to a reduced diameter part 43 of the intermediate head 38. An electrical resistance-type heating element 50 is disposed in coiled fashion around the exterior surface of the liner 48 and suitably disposed in a groove formed therein. The heating element 50 is connected to an electrical conductor 52 which extends through a passage formed in the head member 38 and terminates in a suitable electrical connector 54, FIG. 2B, of a type commercially available, specifically a model 16-B-242 feed through electrical connector manufactured by Kemlon Products & Development Co. of Houston, Tex. The bore 55 of the liner 48 defines in part a chamber 56 which is closed at one end by a piston, generally designated by the numeral 58. The piston 58 is slidably disposed in the liner 48 and is disposed around an elongated actuating rod 60 made up of rod segments 62 and 64 which are threadedly connected by a nut 66. The rod segment 64 includes a first annular groove 68, FIG. 2C, defined by transverse surfaces 70 and 72 and a second annular groove 74 defined in part by sloping surface 76. The rod segment 64 is slidably disposed in a bore 78 formed in the intermediate head 38 and which bore is intersected by a spring biased detent plunger 80. The plunger 80 is supported by a body 81 which is threadedly disposed in the head 38 and is removable therefrom. The actuating rod 60 is locked in a first position as illustrated in FIGS. 2C and 2D by the detent plunger 80 which is disposed in the groove 74. However, the rod 60 may move upwardly, viewing the drawing figures, in response to an actuating force to urge the detent member 80 out of the groove 74 until the rod progresses to a point where the detent member 80 projects into the groove 68 whereupon the rod is effectively locked in a second position.

Referring now to FIG. 2D, the piston 58 is provided with suitable lip type dynamic seals 59 and 61 for sealing the chamber 56 from the exterior of the sampling apparatus. A removable plug 82 is connected to the side of the piston 58 exposed to the exterior of the apparatus 20 through the fluid intake ports 34. As shown in FIG. 2D, the actuating rod 60 is threadedly connected to a closure member 84 which, in the initial or starting position of the apparatus prior to taking a fluid sample, is disposed in the position shown in FIGS. 2C and 2D. The closure member 84 is configured as a generally cylindrical plug or piston having annular seals 59 and 86 disposed on the periphery thereof and covered by a sliding collar 88 which is sleeved over a head portion 89 of the closure member and is retained thereon by a removable screw-type key 90 which projects into a longitudinal groove 92 formed on the closure member. The closure member 84 also includes a sampled fluid discharge passage 94 which opens to the end face 91 of the head portion 89 and is also in communication with a needle-type throttling valve 96, see FIG. 4 also. As shown in FIG. 4, a fluid discharge port 98 is formed in the closure member 84 and is normally closed by a removable plug 100. Port 98 opens into a passage occupied by the throttling valve 96 and may be placed in communication with the passage 94 upon moving the valve element 96 to an open position.

Referring now to FIGS. 2A and 2B, in particular, the apparatus 20 includes a reservoir chamber 102 formed between the intermediate head 38 and the upper head member 36 and within the tubular body part 40. The chamber 102 is adapted to be placed in fluid flow communication with the chamber 56 by way of a rotary plug valve 108, see FIG. 3 also, rotatably disposed in the intermediate head 38 and in communication with the chamber 102 by a passage 110. The valve member 108 is also adapted to be in communication with the chamber 56 by a passage 112 extending through the intermediate head member 38 and opening into the chamber 56 at the head end face 39, FIG. 2C. The valve member 108 is connected to a rotary motor 114 disposed in a housing 116 connected to the intermediate head member 38. The motor 114 is preferably energized by a DC electrical signal from conductor means 120 which terminates in a connector member 122 similar to the connector 54 and disposed in a removable end plug 126 for the housing 116. The motor 114 includes a rotatable output shaft 115 which is driveably connected to the closure member 108 by way of a suitable coupling member 130. The motor 114 may be energized to rotate until a limit position is encountered by engagement of the coupling 130 with a stop member, not shown, or the motor 114 may be a stepping motor which receives a pulse-type signal to rotate the shaft 115 a predetermined number of degrees to move the valve member 108 between open and closed positions. In the position of the valve member 108 illustrated in FIG. 3, the passages 110 and 112 are in communication with each other so that the chambers 56 and 102 are also in communication with each other. However, in response to rotating the valve member 108 approximately 90° in either direction, viewing FIG. 3, the valve member blocks the flow of fluid between the respective chambers.

As shown in FIG. 2A, electrical signals are preferably transmitted to the motor 116 and to the heating element 50 through suitable conductors 134 and 136 which terminate in a conventional wireline cable connector plug 138. The plug 138 is disposed in a support sleeve 140 housed within the connector head 30. The connector head 30 is threadedly connected to the upper head 36 and includes a sleeve extension 141 which is coupled to a support cap 143 for connector members 145 and 147 similar to the connectors 54 and 120. The head 36 includes a fluid vent passage 142 formed therein and opening into the chamber 102. A removable plug 144 is disposed on the upper head member 36 and may be removed for connecting a suitable filler tube, not shown, to the head member for moving fluid into and out of the chamber 102.

In preparing the apparatus 20 for obtaining a fluid sample from the wellbore 10, for example, the position of the piston 58, and the closure member 84 together with its actuating rod 60 is that illustrated in FIGS. 2C and 2D. The piston 58 is preferably moved to the position illustrated in FIG. 2C by pumping a suitable quantity of liquid such as a light mineral oil into the chamber 56 by way of the passage 142, the chamber 102, and the passages 110 and 112 in the intermediate head 38. A suitable quantity of liquid is introduced into the chamber 102 which will, under the pressure of an inert gas, for example, force the piston 58 to the position illustrated in FIG. 2C and completely fill the chamber 56 with liquid. The detent plunger 80 is temporarily removed from the intermediate head 38 to permit the actuating rod 60 to move the closure member 84 to the position illustrated in FIG. 2D if the detent plunger was previously interposed in the groove 68. A sufficient space devoid of liquid is provided in chamber 102 to permit displacement of liquid from the chamber 56 into the chamber 102 during operation of the apparatus to obtain a sample of wellbore fluid. The chamber 102 is preferably vented to atmospheric pressure prior to closure of the passage 142 with the plug 144. Prior to insertion of the apparatus 20 into a wellbore, the valve member 108 is rotated to cut off communication between the passages 110 and 112. Accordingly, the piston 58 cannot move to reduce the volume of the chamber 56 due to the trapped quantity of liquid disposed therein.

The apparatus 20 is then connected to the wireline 18 and lowered into the wellbore through the lubricator 14 or suitable apparatus of a similar type until the apparatus 20 is disposed suitably immersed in a quantity of wellbore liquid. If the wellbore liquid is particularly viscous and the force of gravity alone will not cause the apparatus 20 to penetrate to a suitable depth, electrical current may be passed through the heating element 50 to heat the lower end of the tubular body 28, in particular, to assist in pentration of the body part 42 into a viscous liquid. Alternatively, the apparatus 20 could be lowered into a wellbore on the end of a tubing string having suitable conductor means extending therethrough such as the wireline 18.

Figure 3:
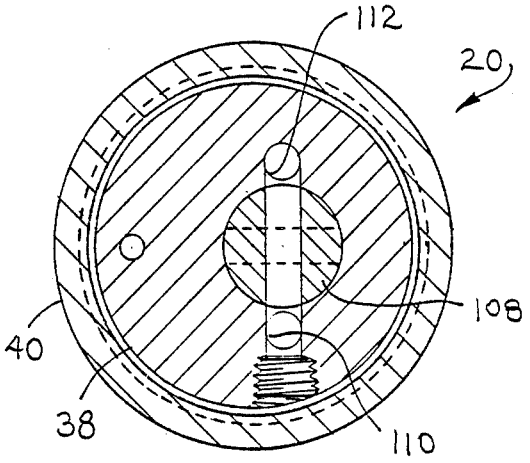
FIG. 3 is a section view taken along the line 3—3 of FIG. 2B.
Figure 5A:
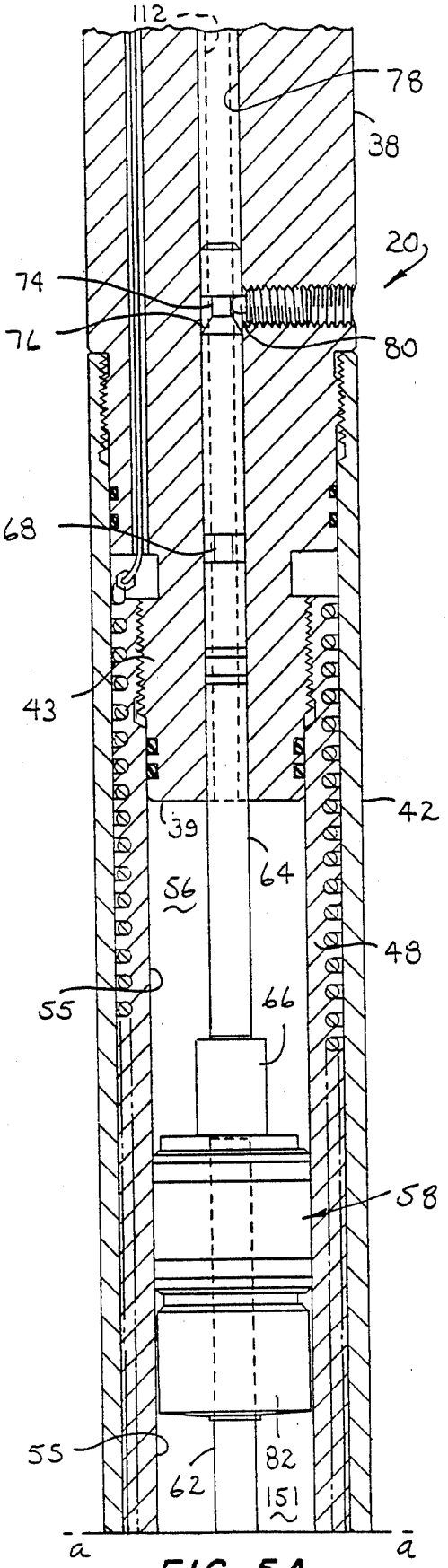
FIGS. 5A and 5B comprise a section view showing the apparatus in a position of the piston just prior to closure of the sample chamber.
Figure 5B:
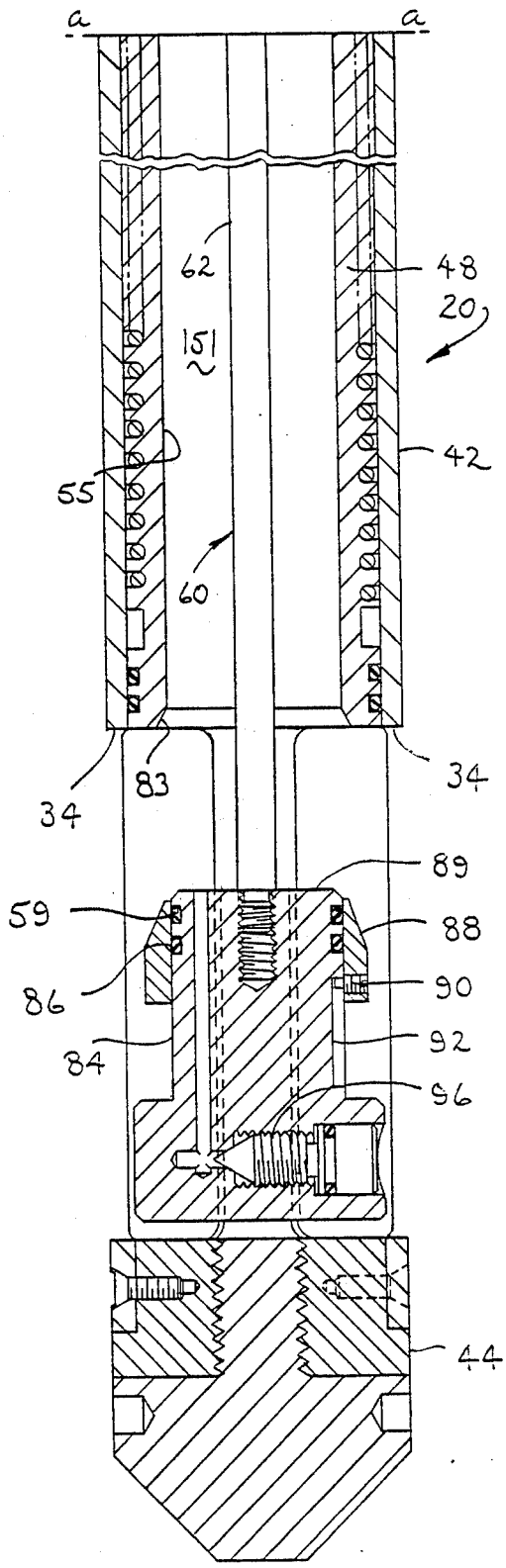

Referring now to FIGS. 5A and 5B, the apparatus 20 is illustrated in a working position such as it would assume in the wellbore 10, for example, and whereupon the motor 114 has been energized to rotate the valve member 108 to the position illustrated in FIG. 3 placing the passages 110 and 112 in communication with each other. With the sampling device 20 immersed in fluid in the wellbore at wellbore pressures, which may range up to several thousand pounds per square inch, the piston 58 will be displaced by fluid in the wellbore flowing through the ports 34 and acting on the piston to displace fluid from the chamber 56 as the piston moves upward toward the nut 66. Liquid displaced from the chamber 56 will flow into the chamber 102 and sufficient space is provided in the chamber 102 to prevent excess compression of gas in the chamber as the liquid is displaced from the chamber 56 to the chamber 102. As a chamber 151 in the body part 42 is filled by the fluid being sampled, the piston 58 moves upward in the chamber 56 until the nut 66 is engaged by the piston. The piston 58 then begins moving the acutating rod 60 upward relative to the intermediate head 38. As fluid pressure urges the piston 58 still further upward in the chamber 56, the closure member 84 is moved toward the lower end of the chamber 151 until the head portion 89 moves into the bore 55 formed by the liner 48 in sealing engagement therewith. The seal protecting collar 88 is responsive to engagement of a beveled surface 83 on the liner 48 to uncover the seals 59 and 86 and permit the closure member 84 to move into the liner bore. As the closure member 84 moves into the liner bore 55, the seal 59 provides a wiping action which cleans the bore surface to provide for a more effective seal between the closure member and the chamber 151.

Figure 6A:
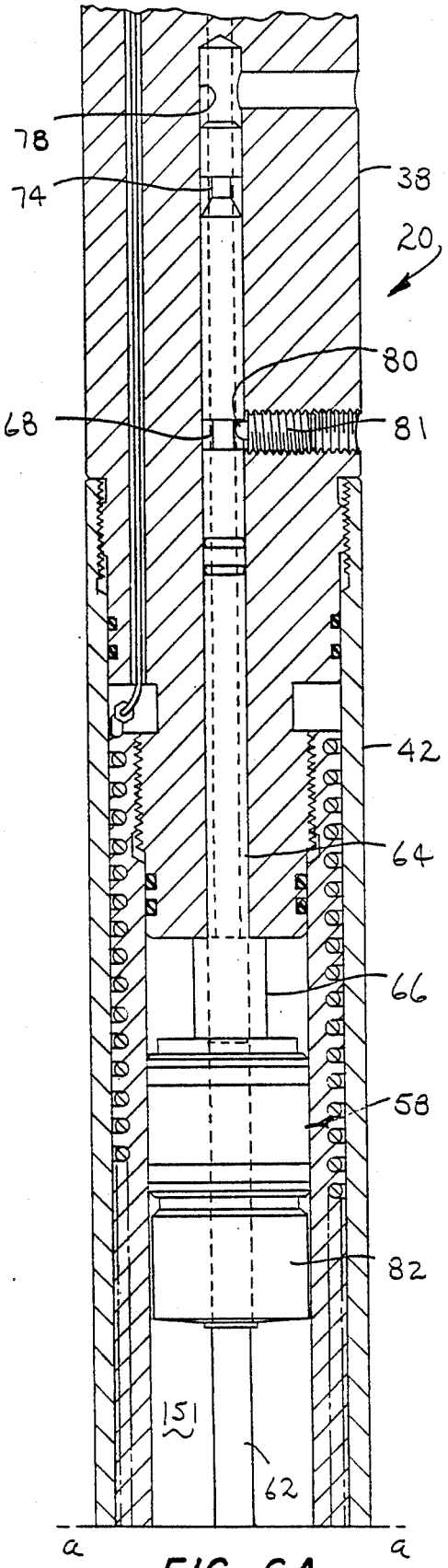
FIGS. 6A and 6B comprise a section view showing the sample chamber closed and locked and ready for discharge of a fluid sample.
Figure 6B:
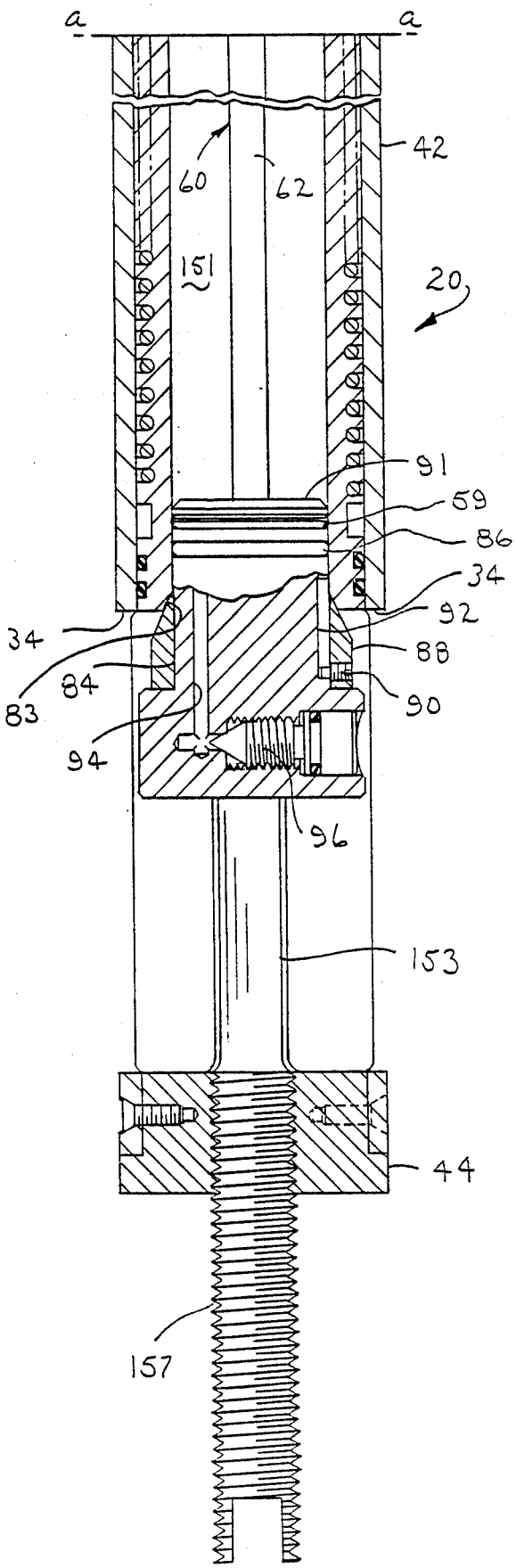

As the acutating rod 60 moves to a position wherein the groove 68 registers with the detent plunger 80, the closure member 84 becomes substantially fully seated in the bore 55 of liner 48 to close off the chamber 151 and capture a sample of wellbore fluid which has flowed into the chamber 151 through the generously sized ports 34, see FIG. 6B. The motor 114 may then be operated to move the valve closure member 108 to a shut-off position to close off communication between the chambers 56 and 102. The apparatus 20 may then be retrieved from the wellbore and disconnected from the wireline 18 for movement to a laboratory setting for transfer of the fluid sample from the chamber 151 to a suitable container.

FIGS. 6A and 6B illustrate the lower portion of the apparatus preparatory to removal of a fluid sample from the chamber 151. To prevent unwanted movement of the closure member 84 during discharge of the fluid sample from the chamber 151, the end cap 47 is removed from the lower head member 44 and replaced by a stop member 153 which includes a shank portion 157 adapted to be threaded into the head member 44 until the stop member is in abutting relationship to the closure member 84 to prevent movement thereof out of the liner 48. The plug 100, FIG. 4, is then removed and a suitable discharge line is connected to the port 98 prior to opening of the valve 96. In order to assure noncontamination of the fluid sample, the port 98 may be suitably connected to a mercury pump or the like for flooding the passages formed by the port 98 and the cavity occupied by the valve 96 with mercury prior to discharge of the sample from the apparatus 20.

The fluid sample in the chamber 151 is removed therefrom by connecting the passage 142 to a source of pressure fluid which will operate to displace fluid from the chamber 102 back to the chamber 56. The motor 114 is operated to open the valve 108 placing the passages 110 and 112 in communication with each other so that the mineral oil or the like may be pumped back into the chamber 56 to displace the piston 58 toward to closure member 84 to displace the fluid sample from the chamber 151. If the fluid sample is a particularly viscous liquid, the heating element 50 may be energized to heat the fluid sample in the chamber 151 to facilitate flow of the sample out of the apparatus 20. When the fluid sample has been extracted, the stop member 153 is removed from the head 44 and the detent plunger 80 is retracted to allow the actuating rod 60 to be moved to position the closure member 84 back to the position illustrated in FIGS. 2C and 2D. The apparatus 20 may then be cleaned, if required, in preparation for capturing another fluid sample.

As will be appreciated from the foregoing description, the apparatus 20 advantageously relies on wellbore pressures exerted on the fluid being sampled to actuate the floating piston 58 and the closure member 84 to capture a suitable sample of fluid in the chamber 151. The generous sizing of the ports 34 and their proximity to the open end of the liner 48 which defines the chamber 151, also provides for collecting samples of particularly viscous fluids. Since a fluid is displaced from the chamber 56 during collection of a sample and this chamber is closed off by the valve member 108, there is substantially a balance of pressure forces acting on the piston 58 during retrieval and removal of the sample from the apparatus 20 even though the apparatus has been subjected to substantial wellbore pressures. Moreover, thanks to the arrangement of the closure member actuating rod 60 and detent plunger 80, a sample of fluid disposed in the chamber 151 is automatically captured in the chamber when a complete sample has been taken upon movement of the closure member 84 into the bore of the liner 48.

The apparatus 20 may be constructed of conventional engineering materials. The bore of the liner 48 is preferably provided with a hard abrasion resistant coating or other suitable hardening process. The piston 58 is initially positioned in the liner bore 55 such that the seals 59 and 61 are protected by the plug 82 and the unique seal protecting collar 88 also minimizes potential damage to the seals 86 on the closure member 84.

Although a preferred embodiment of the present invention has been described in detail herein, those skilled in the art will recognize that various substitutions and modifications may be made to the specific embodiment described without departing from the scope and spirit of the invention as recited in the appended claims.

What I claim is:

1. An apparatus for capturing a sample of fluid from a wellbore characterized by:

an elongated generally tubular body member, said body member including means for connecting said apparatus to means for lowering said apparatus into a wellbore;

said body member including means defining a generally cylindrical bore and port means in said body member opening into said bore for conducting a flow of fluid to be sampled into said bore;

piston means disposed in said bore and dividing said bore into first and second chambers, said first chamber being operable to be in flow communication with said port means for receiving said fluid sample through said port means, and said second chamber being filled with a displacement fluid to prevent displacement of said piston means to increase the volume of said first chamber;

valve means in communication with said second chamber for selectively valving displacement fluid from said second chamber to permit said piston means to increase the volume of said first chamber; and closure means for said first chamber for closing off communication of said first chamber with said port means when said first chamber has received said fluid sample.

2. The appartus set forth in claim 1 including:

a third chamber formed in said apparatus and in communication with said valve means for receiving displacement fluid from said second chamber in response to movement of said piston means.

3. The apparatus set forth in claim 2 wherein:

said valve means includes a closure member moveable between a first position for placing said second and third chambers in communication with each other and a second position for blocking communication between said second and third chambers, and motor means operably connected to said closure member for moving said closure member between said first and second positions.

4. The apparatus set forth in claim 3 wherein:

said motor means comprises an electric motor controllable by an electric signal to move said closure member between said first and second positions.

5. The apparatus as set forth in claim 2 including:

passage means opening from said third chamber to the exterior of said apparatus and adapted for connection to a source of pressure fluid for displacing fluid from said third chamber to said second chamber.

6. The apparatus set forth in claim 1 including:

actuator means connected to said closure means and responsive to the movement of said piston means during displacement of said fluid sample into said first chamber to move said closure means to close off said first chamber when said piston means has reached a predetermined position.

7. The apparatus set forth in claim 6 wherein:

said actuator means comprises an elongated rod connected to said closure means and supported on said apparatus for movement between first and second positions, stop means on said rod engagable with said piston means for moving said rod and said closure means to close off said first chamber from communication with said port means in response to movement of said piston means, and means engageable with said rod for holding said rod in a first position and a second position.

8. The apparatus as set forth in claim 6 wherein:

said closure means comprises a generally cylindrical plug moveable into said bore in said body member, and said apparatus includes seal means cooperable with said plug and said means defining said bore for sealing said first chamber to capture a sample of fluid in said first chamber.

9. The apparatus as set forth in claim 8 wherein:

said seal means are disposed on said closure means and said closure means includes means for covering said seal means and responsive to movement of said plug into said bore to uncover said seal means for sealing engagement with said means defining said bore.

10. The apparatus set forth in claim 1 wherein:

said closure means includes passage means formed therein and adapted to be in communication with said first chamber and valve means interposed in said passage means for communicating said passage means with the exterior of said apparatus for withdrawing a sample of fluid from said apparatus through said closure means.

11. The apparatus set forth in claim 1 including:

stop means adapted to hold said closure means in a position closing said first chamber during withdrawal of said fluid sample from said first chamber.

12. The apparatus set forth in claim 1 including:

heating element means disposed on said apparatus for heating said first chamber to enhance the flow of said fluid sample with respect to said first chamber.

13. An apparatus for capturing a sample of viscous liquid from a wellbore characterized by:

an elongated body member, said body member including means for connecting said apparatus to means for lowering said apparatus into a wellbore;

said body member including means defining a generally cylindrical bore and port means in said body member opening into said bore for conducting a flow of liquid to be sampled into said bore;

a piston disposed in said bore and dividing said bore into first and second chambers, said first chamber being operable to be in flow communication with said port means for receiving said liquid sample through said port means; said piston being movable under the urging of fluid pressure of said liquid sample to move to increase the volume of said first chamber;

closure means for closing off communication of said first chamber with said port means when said first chamber has received said liquid sample; and actuator means connected to said closure means and responsive to the movement of said piston during displacment of said liquid sample into said first chamber to move said closure means to close off said first chamber when said piston has reached a predetermined position.

14. The apparatus set forth in claim 13 wherein:

said actuator means comprises an elongated rod connected to said closure means and supported on said apparatus for movement between first and second positions, stop means on said rod engagable with said piston for moving said rod and said closure means to close off said first chamber from communication with said port means in response to movement of said piston.

15. The apparatus set forth in claim 14 including:

means engageable with said rod for holding said rod in a first position and a second position.

16. The apparatus as set forth in claim 13 wherein:

said closure means comprises a generally cylindrical plug moveable into said bore and seal means on said plug for sealing said first chamber to capture a sample of liquid.

17. The apparatus as set forth in claim 16 including:

means disposed on said closure means for covering said seal means and responsive to movement of said plug to uncover said seal means for sealing engagement with said means defining said bore.

18. The apparatus set forth in claim 13 wherein:

said closure means includes passage means formed therein and adapted to be in communication with said first chamber for withdrawing a sample of liquid from said apparatus through said closure means.

* * * * *